US005730584A

United States Patent [19]

Dodd

[11] Patent Number: 5,730,584

[45] Date of Patent: Mar. 24, 1998

[54] VIBRATION DAMPING

[75] Inventor: Alec G. Dodd, Derby, England

[73] Assignee: Rolls-Royce plc, London, United Kingdom

[21] Appl. No.: 835,359

[22] Filed: Apr. 7, 1997

[30] Foreign Application Priority Data

May 9, 1996 [GB] United Kingdom ..... 9609721

[51] Int. Cl.[6] ..... F04D 29/66

[52] U.S. Cl. ..... 416/190; 416/500

[58] Field of Search ..... 416/248, 500, 416/190

[56] References Cited

U.S. PATENT DOCUMENTS

| | | | |
|---|---|---|---|
| 3,990,813 | 11/1976 | Imai . | |
| 4,722,668 | 2/1988 | Novacek | 416/190 |
| 4,767,273 | 8/1988 | Parttington | 416/190 |
| 4,776,764 | 10/1988 | Ortolano | 416/190 |
| 4,948,338 | 8/1990 | Wickerson | 416/190 |

FOREIGN PATENT DOCUMENTS

| | | | |
|---|---|---|---|
| 284 829A1 | 10/1988 | European Pat. Off. . | |
| 56607 | 4/1982 | Japan | 416/190 |
| 221102 | 8/1994 | Japan | 416/190 |
| 381873 | 10/1932 | United Kingdom . | |
| 708836 | 5/1954 | United Kingdom . | |
| 943023 | 11/1963 | United Kingdom . | |
| 1 309 646 | 3/1973 | United Kingdom . | |
| 1 507 811 | 4/1978 | United Kingdom . | |
| 2033 492 | 5/1980 | United Kingdom . | |
| 105 414 | 3/1983 | United Kingdom . | |

*Primary Examiner*—John T. Kwon

*Attorney, Agent, or Firm*—Cushman Darby & Cushman Intellectual Property Group of Pillsbury Madison & Sutro LLP

[57] ABSTRACT

A damper for damping non-synchronous vibration in adjacent shrouded aerofoil blades is in the form of pin which locates in confronting passages in adjacent blade shrouds. The pin is provided with larger diameter portions which are located totally within the passages and frictionally engage the surfaces of the passages to provide vibration damping. The larger diameter pin portions are interconnected by a central, thinner portion. The configuration of the pin reduces the likelihood of it wearing in such a manner that it jams in the passages and no longer provides vibration damping.

4 Claims, 2 Drawing Sheets

VIBRATION DAMPING

This invention relates to vibration damping and is particularly concerned with the damping of vibration in aerofoil blades suitable for use in gas turbine engines.

Gas turbine engines commonly include an axial flow turbine that comprises at least one annular array of radially extending aerofoil blades mounted on a common disc. Each aerofoil blade is sometimes provided with a shroud at its radially outer tip so that the shrouds of adjacent blades cooperate to define a radially outer circumferential boundary to the gas flow over the aerofoil blades.

In operation, there can be a tendency for the gas flows over the aerofoil blades to cause the blades to vibrate to such an extent that they require some degree of damping. One way of achieving such damping is to interconnect the shrouds of the blades with a single length of wire that passes through appropriate circumferentially extending passages provided in the shrouds. Any vibration of the blades results in relative movement between their shrouds and hence between the passages and the wire. Friction between the passage walls and the wire tends to dampen such relative movement, and hence the blade vibration. Such an arrangement is described and shown in Swiss Patent No. 666326. The drawback with this type of arrangement, however, is that the wire adds undesirable weight to the blade assembly.

Swiss Patent No. 666326 also describes an alternative arrangement in which the single length of wire is replaced by a plurality of short lengths of wire that are in the form of pins. Each pin locates in pair of confronting passages provided in adjacent shrouds. The pins damp blade vibration in the same manner as the continuous piece of wire as a result of friction between the pins and the passage walls. This arrangement has the attraction of being lighter than the arrangement using a continuous piece of wire since less wire is used. However, there can sometimes be a tendency for the pins to wear in such a manner that steps form on them. Such steps are highly undesirable since they can engage the shroud edge and cause jamming of the pin in its corresponding shroud passages. This leads in turn to the pins failing to provide the desired degree of blade vibration damping.

It is an object of the present invention to provide an improved arrangement for damping which enjoys the weight-saving advantages of the pin arrangement described above, but which has a reduced tendency to jam.

According to the present invention, a damper for damping non-synchronous vibration in adjacent, spaced apart components comprises a pin located in both of a pair of generally confronting passages, one passage being provided in each of said adjacent components, said pin having portions configured to frictionally engage the internal surfaces of said component passages, each of said passage engaging portions being so positioned on said pin as to be totally contained within its corresponding component passage, said passage engaging portions of said pin being interconnected by a central, thinner portion.

Preferably, each pin is of circular cross-sectional configuration and is of progressively increasing diameter from its central portion to each of its passage-engaging portions and thence of progressively decreasing diameter to each of its ends.

Since the component passage engaging portions of the pin are totally contained within the passages, there is no likelihood of the pins wearing in such a manner that a step is formed on them. There is therefore a reduced likelihood of the occurrence of jamming.

The present invention will now be described, by way of example, with reference to the accompanying drawings in which.

Figure 1:
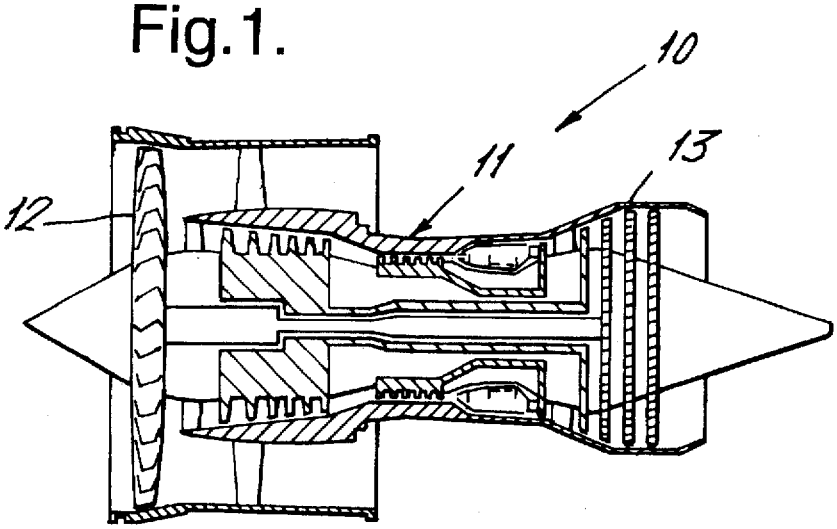
FIG. 1 is a simplified sectioned side view of a ducted fan gas turbine engine incorporating a vibration damper in accordance with the present invention.

With reference to FIG. 1, a ducted fan gas turbine engine generally indicated at 10 is of generally conventional configuration. It comprises a core unit 11 which serves to drive a propulsive ducted fan 12 and also to provide propulsive thrust. The core unit 11 includes a low pressure turbine 13 which comprises three rotary stages of aerofoil blades.

Figure 2:
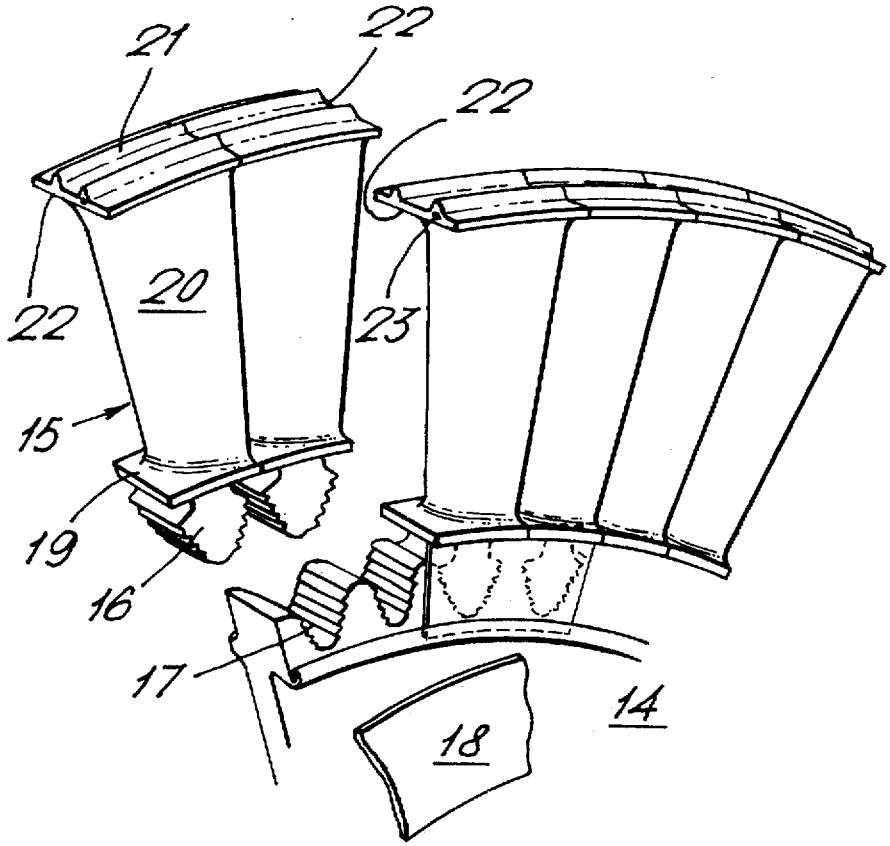
FIG. 2 is a partially exploded view of part of the turbine of the ducted fan gas turbine engine shown in FIG. 1.

Part of one of those low pressure turbine stages can be seen in FIG. 2. It comprises a disc 14 having a plurality of similar radially extending aerofoil blades 15 mounted on its periphery. Each aerofoil blade 15 is formed from a suitable nickel base alloy and has a conventional fir tree cross-section root 16 which locates in a correspondingly shaped slot 17 provided in the disc 14 periphery. The configuration of the root 16 ensures radial constraint of its corresponding aerofoil blade 15 while permitting the root 16 to be slid axially into its corresponding slot 17 in the disc periphery for assembly purposes. Suitable stops (not shown) and seal plates 18 which are subsequently attached to the disc 14 and aerofoil blades 15 ensure the axial retention of the aerofoil blades 15 on the disc In addition to having a root 16, each aerofoil blade 15 comprises an inner platform 19 positioned adjacent the root 16, an aerofoil portion 20 extending radially outwardly from the inner platform 19 and a shroud 21 positioned on the radially outer extent of the aerofoil portion 20. The inner platforms 19 of adjacent aerofoil blades 15 co-operate to define a radially inner boundary to the gas path over the aerofoil portions 20. Similarly, the shrouds 21 of adjacent aerofoil blades 15 co-operate to define a radially outer boundary to the gas path over the aerofoil portions 20.

Each of the inner platforms 19 and outer shrouds 21 is circumferentially spaced apart by a small distance from its adjacent platform 19 or shroud 21. This is to allow for the vibration of the aerofoil blades 15 which inevitably occurs when gases flow over them during operation of the engine 10. It is this gas flow which causes the aerofoil blades 15 to rotate the disc 14 upon which they are mounted.

Excessive aerofoil blade vibration is usually looked upon as being undesirable since it can lead to premature component failure through cracking. The present invention is concerned with the damping of vibration in order to avoid such premature component failure.

Figure 3:
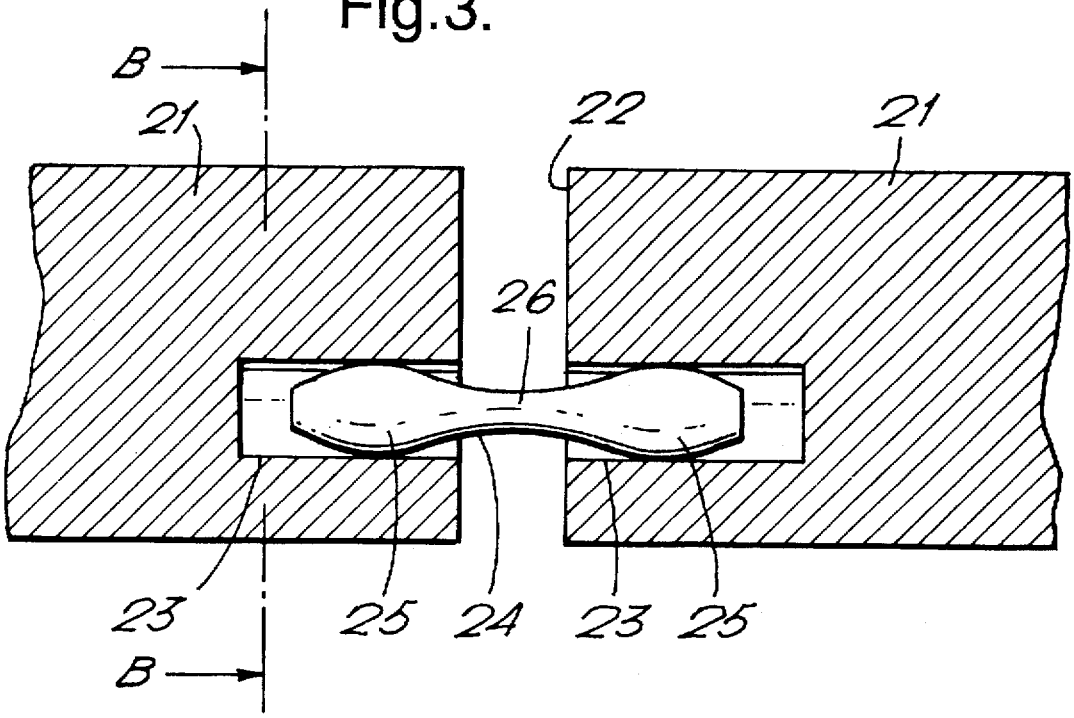
FIG. 3 is a view on section line A—A of FIG. 4 showing a part of the turbine shown in FIG. 2 that includes a damper in accordance with the present invention.

Vibration damping is provided by dampers in accordance with the present invention that are associated with each of the shrouds 21. Each shroud 21 is provided at each of its circumferential edges 22 with a blind circumferentially extending circular cross-section passage 23. Each passage 23, as can be seen more clearly in FIG. 3, confronts the passage in the adjacent shroud 21. Each pair of confronting shroud passages 23 contains a damper 24 which is in the form of a metallic pin interconnecting the adjacent shroud passages 23. The pin 24, which is preferably formed from a nickel base alloy, is of circular cross-sectional configuration and has portions which are of greater diameter than other portions. More specifically, the pin 24 has two similar larger diameter portions 25 that are interconnected by a smaller diameter portion 26. Additionally the pin 24 diameter varies progressively from its smaller diameter central portion 26 to each of its larger diameter portions 25 and thence decreases to each of its ends.

Figure 4:
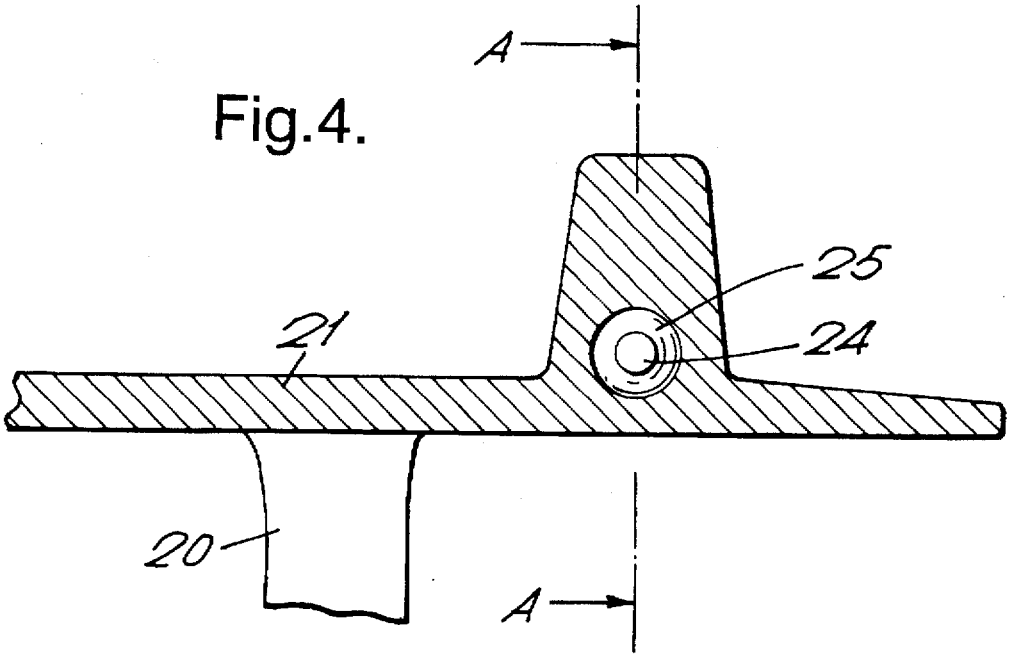
FIG. 4 is a view on section line B—B of FIG. 3.

Each of the larger diameter pin portions 25 is of such a diameter that it is a close frictional fit within its corresponding shroud passage 23 as can be seen in FIG. 4. It will be seen therefore that since there is continuous variation in the diameter of the pin 24, contact between each larger diameter pin portion 25 and its corresponding shroud passage 23 internal surface is in the form of line contact. Thus, the greatest circumference of each larger diameter pin portion 25 is in line contact with the internal wall of its corresponding shroud passage 23. That greatest circumference part of each larger diameter pin portion 25 is so positioned on the pin 24 that each of the portions 25 of the pin 24 that engages the internal wall of its associated shroud passage 23 is totally contained within that passage 23.

If the aerofoil blades 15 are subject in use to non-synchronous vibration, there will be relative movement between the blades 15. Since the aerofoil blades 15 are attached to the disc 14 at their radially inner extents, that relative movement tends to be of greatest magnitude in the region of the blade shrouds 21. The vibration is likely to be in one or both of two main modes: flutter and torsional oscillation. Notwithstanding the particular mode or modes involved, vibration of the blades 15 results in adjacent shrouds 21 moving relative to each other in both circumferential and axial directions (with respect to the longitudinal axis of the engine 10). Such relative shroud 21 movement results in the pins 24 sliding within the passages 23. This sliding movement is resisted by friction between the walls of the passages 23 and those portions of the pins 24 that engage those walls, thereby providing damping of the movement. The pins 24 therefore provide damping of non-synchronous vibration of adjacent aerofoil blades 15.

During sustained operation of the ducted fan gas turbine engine 10, it is inevitable that the pins 24 will eventually wear to the extent that there will no longer be line contact between each pin 24 and its associated passage 23 wall. However, since the passage 23 wall engaging portions of each pin 24 are contained wholly within the pin's corresponding passage 23, there is no danger of steps being formed on the pins 24. Consequently, the pins 24 will not jam relative to their associated shrouds 21 and cease providing vibration damping.

A further advantage of the particular configuration of the pins 24 is that they will function satisfactorily even if there is a limited degree of mis-alignment of the confronting passages 23.

Although the present invention has been described with reference to the damping of turbine blades, it will be appreciated that it is generally applicable to other situations in which two adjacent components are subject to non-synchronous vibration. Moreover, although the present invention has been described with respect to single turbine blades which are interconnected by damping pins, it may be desirable in certain circumstances to utilise turbine blades which are grouped in pairs. Thus an adjacent pair of turbine blades would share integral shrouds and platforms. Under these circumstances only the circumferential extents of the common shrouds would be provided with pin-receiving passages.

I claim:

1. A damper for damping non-synchronous vibration in adjacent, spaced apart components comprising a pin located in both of a pair of generally confronting passages, one passage being provided in each of said adjacent components, said pin having portions configured to frictionally engage the internal surfaces of said component passages, said pin being of progressively increasing diameter from its central portion to each of its passage-engaging portions and thence of progressively decreasing diameter to each of its ends, each of said passage engaging portions being so positioned on said pin as to be totally contained within its corresponding component passage.

2. A damper as claimed in claim 1 wherein said pin is metallic.

3. A damper as claimed in claim 1 wherein each of said components is part of an aerofoil blade.

4. A damper as claimed in claim 3 wherein each of said aerofoil blades is provided with a shroud at its radially outer tip, said passages being provided in said shrouds.

* * * * *